US005836517A

United States Patent [19]

Burns et al.

[11] Patent Number: 5,836,517

[45] Date of Patent: Nov. 17, 1998

[54] SPRAY GUN WITH FLUID VALVE

[75] Inventors: Marvin D. Burns, Millbury, Ohio; Mark E. Charpie, Lambertville; Thomas E. Grime, Temperance, both of Mich.

[73] Assignee: Ransburg Corporation, Indianapolis, Ind.

[21] Appl. No.: 367,837

[22] Filed: Jan. 3, 1995

[51] Int. Cl.[6] ..... B05B 1/28

[52] U.S. Cl. ..... 239/290; 239/416; 239/525; 239/581.1; 251/209

[58] Field of Search ..... 239/290, 296, 239/525, 526, 416, 581.1, 586, 311, 318; 251/209, 121

[56] References Cited

U.S. PATENT DOCUMENTS

| | | | |
|---|---|---|---|
| 1,787,583 | 1/1931 | Larson | 239/416.2 |
| 1,913,149 | 6/1933 | Atwater | 251/209 |
| 2,754,153 | 7/1956 | Barthod | 239/416.2 |
| 2,780,496 | 2/1957 | Asbeck et al. | 239/290 |
| 3,037,709 | 6/1962 | Bok et al. | 239/290 |
| 4,653,691 | 3/1987 | Grime | 239/318 |
| 4,959,159 | 9/1990 | Mattson | 239/526 |
| 4,969,603 | 11/1990 | Norman | 239/318 |
| 5,102,051 | 4/1992 | Smith et al. | 239/526 |
| 5,236,129 | 8/1993 | Grime et al. | 239/526 |
| 5,322,221 | 6/1994 | Anderson | 239/296 |
| 5,332,156 | 7/1994 | Wheeler | 239/526 |
| 5,332,159 | 7/1994 | Grime et al. | 239/526 |
| 5,395,054 | 3/1995 | Wheeler | 239/290 |

FOREIGN PATENT DOCUMENTS

| | | |
|---|---|---|
| B 2338/61 | 3/1963 | Australia . |
| B 31188/63 | 12/1964 | Australia . |
| B 39763/64 | 7/1965 | Australia . |
| B 10209/70 | 3/1971 | Australia . |
| B 21653/77 | 1/1977 | Australia . |
| A 85602/75 | 4/1977 | Australia . |
| B 44300/1979 | 8/1979 | Australia . |
| B 23020/62 | 4/1994 | Australia . |

*Primary Examiner*—Andres Kashnikow
*Assistant Examiner*—Lisa Ann Douglas
*Attorney, Agent, or Firm*—MacMillan, Sobanski & Todd, LLC

[57] ABSTRACT

A spray gun having a fluid flow control valve which is preferably located in a spray head. The flow control valve eliminates the need to change the spray head or fluid tip to change the flow rate in a suction feed and/or gravity feed paint spray gun when different materials are sprayed. The valve has a member which is rotatable over no greater than 3600° and preferably over about 90° for adjusting the flow rate. Calibration marks may be provided for setting the valve for flow rates produced by standard fluid discharge orifice sizes.

6 Claims, 3 Drawing Sheets

SPRAY GUN WITH FLUID VALVE

TECHNICAL FIELD

The invention relates to spray guns and more particularly for a spray gun having an integral fluid flow control valve which is preferably located in a spray head.

BACKGROUND ART

In both suction feed and gravity feed paint spray guns, the fluid is delivered to and discharged from an orifice in a fluid tip or spray head. Typically, a valve needle seats against an interior end of the orifice for controlling the discharge of fluid from the orifice. As a trigger is actuated, the valve needle is moved in an axial direction away from the interior end of the orifice to allow fluid to flow through the orifice. As the fluid is discharged from the orifice, the fluid stream is impinged with surrounding atomization air and broken up into very fine droplets which are carried by the air towards a workpiece being painted. In a common nozzle construction for a spray gun, the atomization air flow creates a negative pressure at the fluid discharge orifice for drawing fluid through the orifice. Suction feed of the fluid caused by the negative pressure may serve as the only method for feeding fluid to the orifice, or it may work in combination with gravity or pressure feed, or the fluid may flow to the discharge orifice only by gravity or pressure feed.

For a given size fluid discharge orifice, the flow rate will be a function of the feed pressure and/or suction and of properties of the fluid, such as fluid viscosity. It is sometimes desirable to change the rate which fluid is discharged from the spray gun. For suction feed and gravity feed spray guns, there are two methods for changing the fluid flow for a given fluid feed pressure and/or suction. The first method is for the operator to change the fluid tip to a tip having a different orifice diameter. This requires the operator to stop spraying, clean the gun, remove the current fluid tip and replace it with a fluid tip having an appropriate orifice size. The operator was required to maintain several fluid tips with orifices calibrated for the different coating requirements that would be encountered. When the operator did not have the proper size fluid tip for an application, a tip having a larger orifice size than needed would be used and the operator would have to throttle the fluid valve to reduce the fluid flow to the desired rate. The fluid valve may be throttled by only partially squeezing the trigger so that the fluid valve is only partially opened or by an adjustable stop which limits the travel of the fluid valve needle. This will reduce the fluid flow through the orifice. However, on many spray guns, the fluid valve needle does not pull straight back from its seat on the interior end of the orifice due to concentricity variations in the spray gun components. When the fluid valve needle does not pull straight back, a deformed spray pattern may be produced. It should be appreciated that when the orifice size is selected to provide a desired flow rate, the flow rate can only be reduced by throttling the fluid valve. The flow rate cannot be increased beyond that permitted by the selected orifice size without changing to a fluid tip having a larger orifice.

In one type of spray gun, a paint cup depends from a gun body adjacent to a nozzle assembly. Paint is delivered through suction feed to the nozzle assembly. Attempts have been made for controlling the flow of fluid to the nozzle assembly by placing a needle valve in series between the cup and the gun barrel. Although this provided control over the paint flow, it was not totally satisfactory. The valve was opened and closed by rotating the valve needle several turns. The valve was not capable of being calibrated. The fluid discharge rate could be adjusted only by rotating the valve while spraying and having a skilled operator make a judgement decision when the flow rate was appropriate for the material and the specific coating operation. Rotatable valve needles also have been used to control fluid flow in internal mix spray guns. Again, a skilled operator was required to accurately adjust the valve. A fluid flow control valve has been used with a top mounted cup, i.e., a spray gun in which the cup is mounted above the gun body for either gravity feed or a combination of suction and gravity feed.

DISCLOSURE OF INVENTION

According to the invention, the size of the fluid discharge orifice in a paint spray gun is selected for the maximum desired fluid flow rate. The fluid flow rate is decreased by a fluid flow valve mounted in the spray gun and preferably mounted in a spray head. The fluid flow valve has a rotatable valve member which preferably rotates over a range of about 90°, and no greater than 360°, and is calibrated to show incremental flow changes. The calibrations may be, for example, marked to show the flow rates for different standard fluid discharge orifice sizes which are used in commercial spraying operations, such as automobile body repair shops. The valve member has a profile which provides for linear changes in flow rate for uniform rotation of the valve member. The fluid valve permits the operator to rapidly and accurately change the fluid flow rate without the need to change the fluid tip or to throttle the trigger valve and the indexing allows the operator to set the flow rate to rates produced by standard fluid discharge orifice sizes. Since the trigger valve needle is used only to initiate and interrupt fluid flow, problems with pattern distortion caused by erratic movement of the valve needle are eliminated.

Accordingly, it is an object of the invention to provide a spray gun with a fluid flow control valve to eliminate the need to change the fluid tip size or to throttle the trigger valve for adjusting the fluid discharge rate.

Other objects and advantages of the invention will become apparent from the following detailed description of the invention and the accompanying drawings.

BEST MODE FOR CARRYING OUT THE INVENTION

Figure 1:
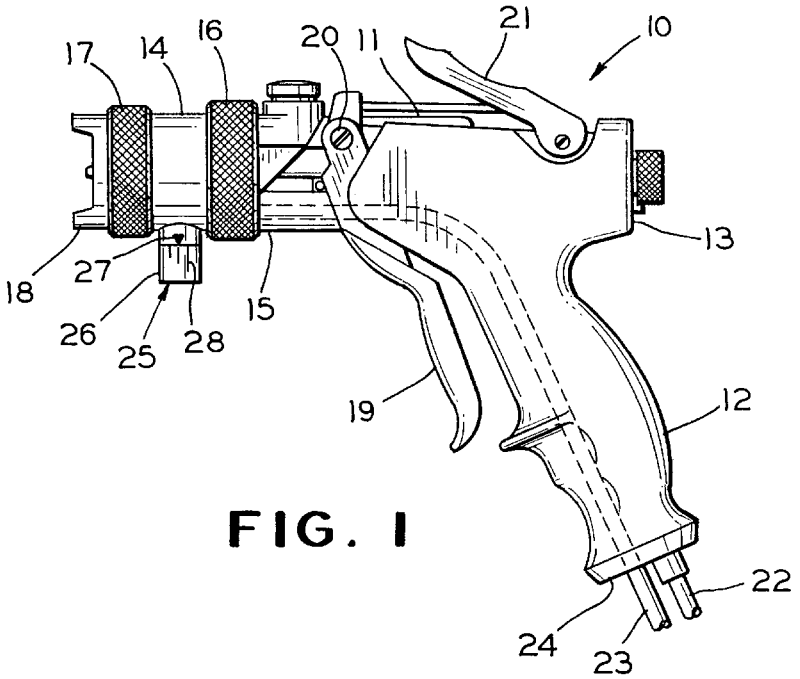
FIG. 1 is a side elevational view of a spray gun according to one embodiment of the invention.

Referring to FIG. 1 of the drawings, a hand held paint spray gun 10 is illustrated according to one embodiment of the invention. The spray gun 10 has a body 11 having an integral handle 12 depending from adjacent one end 13 and a spray head 14 secured to an opposite end 15 by a retaining ring 16. A second retaining ring 17 secures an air cap 18 on the spray head 14. A trigger 19 is secured to the body 11 by a screw 20 to pivot towards the handle 12 when manually squeezed to turn on the spray gun 10. Optionally, an auxiliary trigger 21 may be mounted to extend above the body 11 and to pivot towards the body 11 when manually squeezed. The auxiliary trigger 21 is used, for example, when the spray gun 10 is turned to point downwardly for painting top surfaces. A compressed air hose 22 and a fluid hose 23 are attached to a free end 24 of the handle 12. Compressed air from the hose 22 is applied in a conventional manner through passages (not shown), a trigger actuated air valve (not shown) and the spray head 14 to supply atomization air and spray pattern shaping air to the air cap 18. Preferably, the fluid hose 23 is threaded through the handle 12 and the gun body 11 and connected directly to the spray head 14 to simplify cleanup after spraying is completed. Fluid flows to the fluid discharge orifice in the spray head 14 either through the use of a pressurized fluid source, (not shown), or through a combination of fluid pressure and suction produced by the action of the atomization air.

According to one aspect of the invention, a fluid valve 25 is mounted in the spray head 14 for adjusting the rate that fluid is discharged from the spray gun 10 when the trigger 19 is squeezed. The fluid valve 25 includes a manually rotatable valve member 26 which extends below the spray head 14. The valve member 26 is rotatable over a range no greater than 360°, and preferably of about 90°, to adjust the fluid flow. An index mark 27 is located on the spray head 14 and index marks 28 are located on the valve member 26 for indicating the setting of the fluid valve 25. The index marks 28 may be located to correspond to flow rates produced by standard fluid tip sizes found on conventional spray guns. For example, standard fluid tips used for automobile refinishing may have paint discharge orifices ranging from 0.8 mm to 1.8 mm. The spray head 14 may be provided with a 1.8 mm fluid discharge orifice (not shown). When the valve member 26 is rotated so that the valve 25 is fully open, the flow to the fluid discharge orifice is not inhibited by the valve 25 and the spray gun 10 will function as any spray gun having a 1.8 mm fluid discharge orifice. Index marks 28 may be provided for easily setting the valve 25 to produce the same flow rate as are produced by a 1.2 mm fluid discharge orifice and by a 0.8 mm fluid discharge orifice, or by any other desired orifice size.

Figure 2:
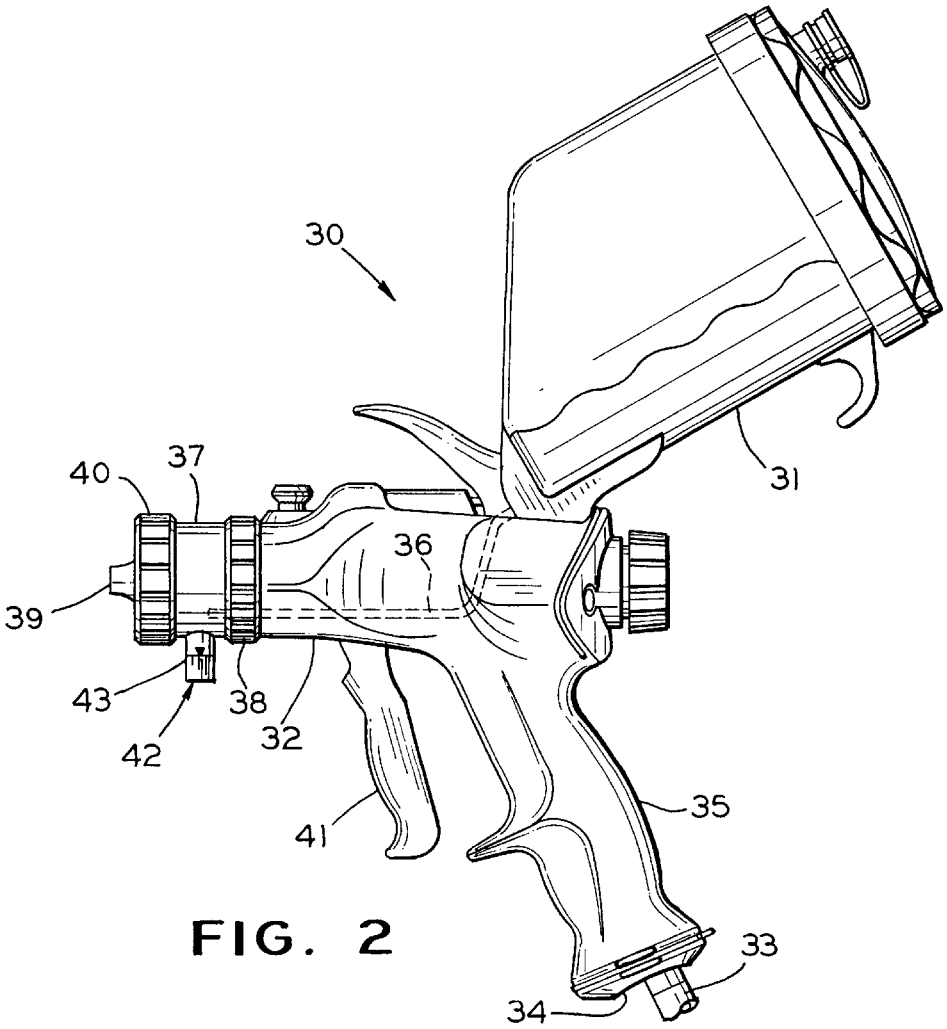
FIG. 2 is a side elevational view of a spray gun according to a second embodiment of the invention.
Figure 3:
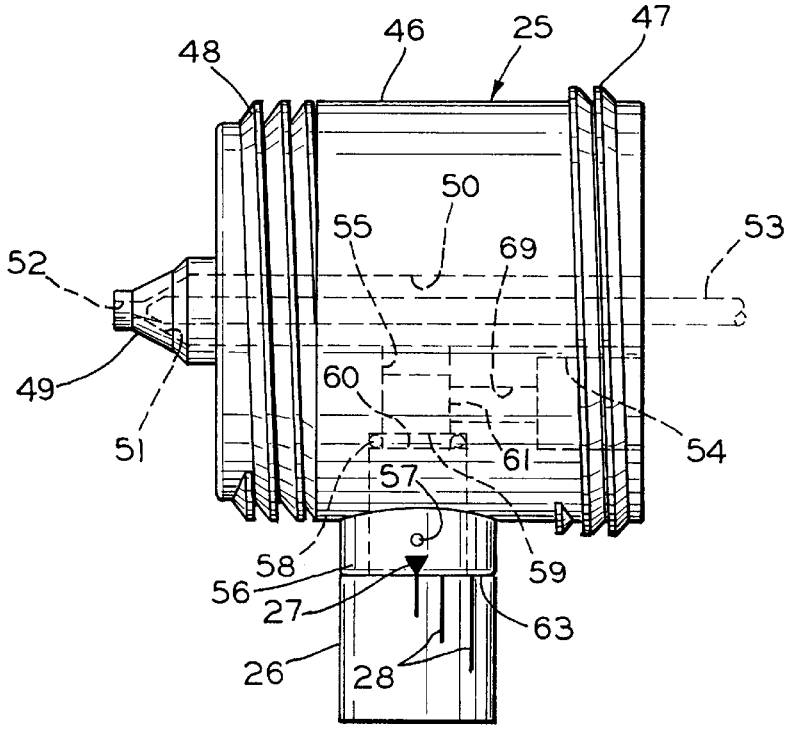
FIG. 3 is an enlarged side elevational view of a spray head embodying the invention for use in the spray guns of FIGS. 1 and 2.
Figure 4:
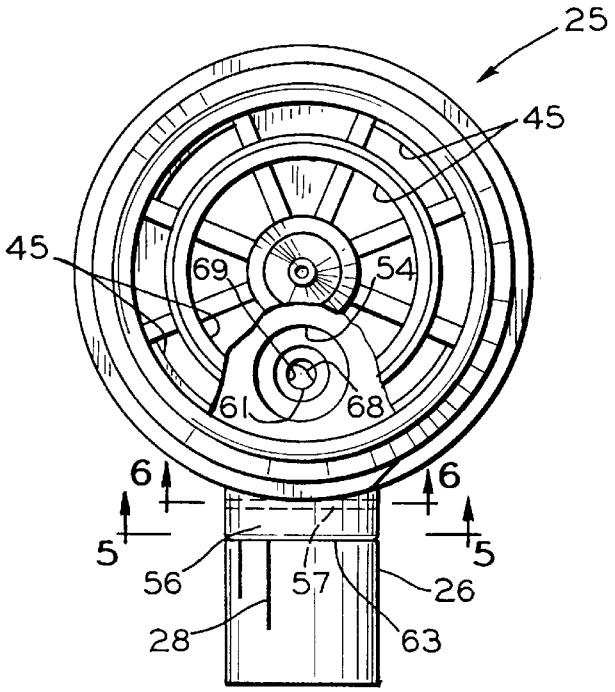
FIG. 4 is a rear elevational view of the spray head of FIG. 3.

FIG. 2 shows a modified embodiment of a spray gun 30 incorporating the invention. The spray gun 30 has a top mounted paint cup 31 which extends above and to the rear of a body 32. Only a compressed air hose 33 is attached to a free end 34 of a handle 35. A tube 36 delivers a flow of paint from the paint cup 31 to a spray head 37 which is secured to the body 32 by a retaining ring 38. An air cap 39 is secured to the spray head 37 by a second retaining ring 40. When a trigger 41 is squeezed, compressed air flows from the hose 33 through the gun body 32, the spray head 37 and is discharged from the air cap 39. At the same time, fluid is discharged from an orifice (not shown) in the spray head 37 and is atomized by the air flow. The spray head 37 includes a fluid valve 42 having a rotatable valve member 43 for adjusting the rate at which fluid is discharged from the spray head 37. For the spray gun 30, fluid may flow to the fluid discharge orifice either through suction produced by the discharge of atomization air around the fluid discharge orifice, or through gravity resulting from positioning the paint cup 31 above the fluid discharge orifice, or through a combination of suction and gravity feed.

The spray head 37 of FIG. 2 is of a similar construction to the spray head 14 of FIG. 1. In both FIGS. 1 and 2, the fluid valves 25 and 42 are illustrated as being incorporated in the spray head 14 and 37, respectively. It will be appreciated to those skilled in the art that when fluid passages are located in the spray gun body, a fluid valve of the type described alternately may be located in the spray gun body for controlling the flow of fluid to a fluid discharge orifice located either in a spray head or a conventional fluid tip. In the spray gun illustrated in FIG. 2, for example, a fluid valve of the type described could be located at any point in the paint tube 36.

FIGS. 3–6 show details of the spray head 14 and of the fluid valve 25 from FIG. 1. The spray head 14 has a generally cylindrical central portion 46 having an externally threaded rear end 47 for engagement by the retaining ring 16 (FIG. 1) and an externally threaded front end 48 for engagement by the air cap retaining ring 17 (FIG. 1). A plurality of air passages 45 extend through the spray head for delivering atomization air and pattern shaping air to the air cap 18 (FIG. 1). A fluid tip portion 49 projects coaxially from the front end 48. An axial fluid passage 50 extends through the spray head 14 to a conical end 51. A fluid discharge orifice 52 extends from the conical passage end 51 axially through the fluid tip portion 49. A trigger operated fluid valve needle 53 (shown in phantom in FIG. 3) seats against the conical passage end 51 to interrupt fluid discharge from the orifice 52 when the spray gun is turned off and is moved axially away from the conical passage end 51 when the trigger is squeezed to initiate fluid discharge from the orifice 52.

Fluid flows from its source to a passage 54 in the spray head 25. A stepped opening 55 connects the passage 54 to the fluid passage 50. The stepped opening 55 extends coaxially through a tubular projection 56 which extends below the central portion 46. The valve member 26 extends from below the tubular projection 56 into the opening 55 and is retained in the opening 55 by a pin 57 which engages the tubular projection 56. An o-ring seal 58 is located between a step 59 in the opening 55 and a step 60 on the valve member 26 to prevent fluid leakage while permitting rotation of the valve member 26. As will be described in greater detail below, the valve member 26 has an end 61 which is located between the fluid passage 54 and the stepped opening 55. The end 61 has a profile for selectively blocking and unblocking fluid flow from the fluid passage 54 through the stepped opening 55 to the fluid passage 50.

Figure 5:
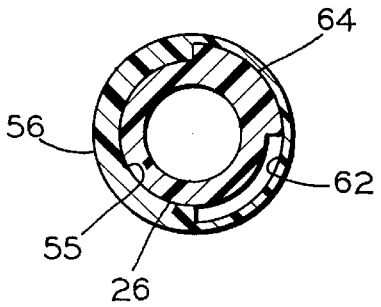
FIG. 5 is a cross sectional view as taken along line 5—5 of FIG. 4.

The valve member 26 rotates in the stepped opening 55 over a limited range of no greater than 360° and preferably about 90°. By limiting rotation of the valve member 26 to no greater than 360°, the valve 25 is easily set and predetermined settings may be indicted by the calibration or index marks 27 and 28. FIG. 5 illustrates one method for limiting rotation of the valve member 26. The valve member 26 has a close fit in the stepped opening 55 to limit the valve member 26 to rotation. A shallow enlarged diameter radial groove 62 extends a portion of the way around the stepped opening 55 at a free end 63 (FIGS. 3 and 4) of the tubular projection 56. A radial flange 64 on the valve member 26 extends into the groove 62. The groove 62 may extend, for example, over an arc of 180° and the flange 64 will then extend over an arc of 90° to limit rotation of the valve member 26 to 90°. It will be appreciated that rotation may be limited to other ranges using the same structure. The difference between the arc of the groove 62 and the arc of the flange 64 will define the range over which rotation of the valve member 26 is restricted.

Figure 6:
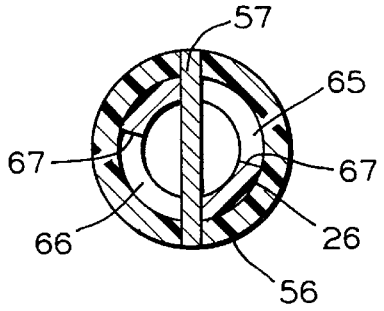
FIG. 6 is a cross sectional view as taken along line 6—6 of FIG. 4.

In order to permit the valve member 26 to rotate while retaining the valve member 26 in the stepped opening 55, two diametrically opposing slots 65 and 66 are formed in the valve member 26 for the pin 57, as is shown in FIG. 6. The slots 65 and 66 are separated by support webs 67 which provide structural integrity to the valve member 26. It will be appreciated that the slots 65 and 66 in combination with the pin 57 could be used to limit rotation of the valve member 26 rather than the groove 62 and the flange 64.

Figure 7:
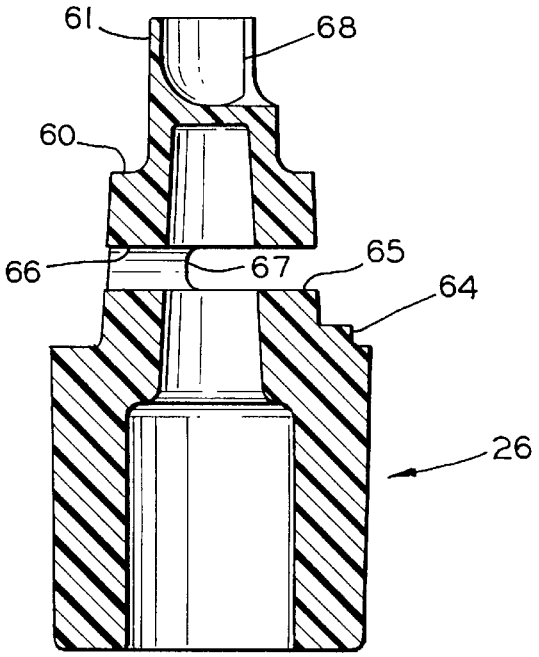
FIG. 7 is a vertical cross sectional view through the valve member.
Figure 8:
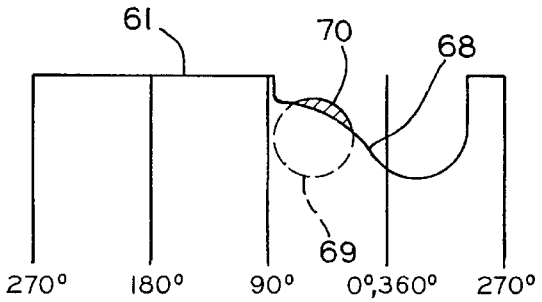
FIG. 8 is projection of the profile of the end of the valve member.

FIGS. 7 and 8 show surface details of the end 61 of the valve member 26. The end 61 has a shaped portion 68 which is shown in detail in the projection in FIG. 8. The shaped portion 68 is rotated past a small diameter end 69 of the fluid passage 54 to adjust the size of the opening between the fluid passage end 69 and the stepped opening 55. The passage end 69 is shown in phantom against the shaped surface portion 68. Fluid will only flow through the shaded area 70 of the hole 69 which is not blocked by the valve member end 61. Prior art fluid valves typically either used a tapered valve needle or a spherical surface which is moved away from a seat when the valve is opened. These designs do not provide linear adjustments. Specifically, for a prior art rotary valve, the first 15° of rotation of a valve member did not provide the same change in flow rate as the next 15° of rotation. Preferably, the surface portion 68 is shaped so that over the limited range of rotation of the valve member 26, each increment of movement provides substantially the same change in flow rate as with each other identical increment of movement. However, the surface portion 68 may be shaped to provide any desired flow rate for discrete positions of the valve member 26. It should be noted that since the fluid flow to the fluid discharge orifice is turned on and off by the trigger operated fluid valve, it is not necessary for the valve 25 to have the capability of completely blocking fluid flow. When fully open, the valve 25 will provide uninhibited flow to the fluid discharge orifice so that the maximum flow rate is determined by the orifice diameter, such as a 1.8 mm diameter orifice. When the valve member 26 is rotated to its maximum closed position, the fluid flow rate corresponds to the smallest needed diameter fluid discharge orifice, such as a 0.8 mm diameter orifice.

It will be appreciated that various modifications and changes may be made to the above described preferred embodiment of the invention without departing from the spirit and the scope of the following claims. In particular, it should be appreciated that the invention may be adapted to various known types of paint spray guns, including both high pressure air atomization and high volume low pressure (HVLP) spray guns and spray guns having either suction fluid feed or gravity fluid feed or pressure fluid feed, or a combination of types of fluid feed. Although in the preferred embodiment, the fluid valve is located in the spray head, it also will be appreciated that for some prior art spray guns having a fluid passage in the spray gun body, the fluid valve may be mounted in the spray gun body.

We claim:

1. A spray head for a spray gun having passages in a spray gun body for delivering fluid and pressurized air to said spray head, said spray head being adapted to be detachably mounted on the spray gun body, said spray head having a fluid discharge orifice, a fluid inlet passage adapted to receive fluid from a passage in the spray gun body and to deliver such fluid to said fluid discharge orifice and a valve surface adapted for cooperating with trigger operated valve needle to form a trigger operated valve for initiating and terminating the discharge of fluid from said fluid discharge orifice, and wherein said spray head is characterized by a valve mounted in said spray head upstream from said valve surface to limit flow of fluid to said fluid discharge orifice when the trigger operated valve is open.

2. A spray head, as set forth in claim 1, and wherein said spray head includes an opening which intersects said fluid delivery passage, and wherein said valve includes a valve member mounted in said opening to rotate, and means for limiting rotation of said valve member to no greater than 360°.

3. A spray head, as set forth in claim 2, and wherein said means for limiting rotation limits rotation of said valve member to about 90°.

4. A spray head, as set forth in claim 2, and wherein said valve member includes a profile which progressively blocks said fluid delivery passage as said valve member is rotated in a predetermined direction and progressively opens said fluid delivery passage as said valve member is rotated in a direction opposite said predetermined direction.

5. A spray head, as set forth in claim 4, and wherein said profile is selected to provide predetermined incremental changes in the rate of fluid flow to said fluid discharge orifice for uniform incremental rotations of said valve member.

6. A spray head, as set forth in claim 5, and further including idexing means for indicating settings of said valve member for establishing flow rates corresponding to flow rates produced by a plurality of different standard size spray gun fluid discharge orifices.

* * * * *